US006450724B1

(12) United States Patent
Cambio

(10) Patent No.: US 6,450,724 B1
(45) Date of Patent: Sep. 17, 2002

(54) LIQUID APPLICATOR DEVICE

(76) Inventor: Tina R. Cambio, 437 Broadview Ave., Highland Park, IL (US) 60035

( * ) Notice: Subject to any disclaimer, the term of this patent is extended or adjusted under 35 U.S.C. 154(b) by 0 days.

(21) Appl. No.: 10/113,275

(22) Filed: Apr. 1, 2002

(51) Int. Cl.[7] ..... A46B 11/04

(52) U.S. Cl. ..... 401/270; 401/183; 401/185; 401/269

(58) Field of Search ..... 401/270, 269, 401/273, 278, 183, 185, 17, 39, 24, 18

(56) References Cited

U.S. PATENT DOCUMENTS

| | | | | |
|---|---|---|---|---|
| 2,291,282 A | | 7/1942 | Hollenbeck | |
| 2,944,274 A | | 7/1960 | Hopkins | |
| 3,565,540 A | * | 2/1971 | Andrews | 401/269 |
| 3,592,202 A | * | 7/1971 | Jones | 401/269 |
| 4,594,014 A | | 6/1986 | Korper | |
| 4,838,722 A | | 6/1989 | Katz | |
| 5,186,674 A | | 2/1993 | Beckhusen et al. | |
| 5,271,513 A | | 12/1993 | Crosnier et al. | |
| 5,622,283 A | | 4/1997 | Morrison | |
| D419,776 S | | 2/2000 | Frost et al. | |

* cited by examiner

*Primary Examiner*—David J. Walczak

(57) ABSTRACT

A liquid applicator device for selectively applying liquids such as paint used by children. The liquid applicator device includes an elongate tubular housing that has a conical-shaped nose portion being disposed at a front end thereof, and a conical-shaped cap support portion that is disposed at a back end thereof. The housing is designed for storing a liquid. A valve member is disposed in the housing to regulate dispensing of the liquid from the housing. A brush cap member and an end-cap member are both removably attachable to either end of the housing, depending on which configuration the device is in, those being either a stored configuration, or an in-use configuration. A pair of elongate, cord-like securing members secures each of the cap members to the tubular member to prevent the child from inadvertently swallowing either of the caps.

12 Claims, 2 Drawing Sheets

LIQUID APPLICATOR DEVICE

BACKGROUND OF THE INVENTION

1. Field of the Invention

The present invention relates to liquid applicators and more particularly pertains to a new liquid applicator device for selectively applying paints used by children.

2. Description of the Prior Art

The use of liquid applicators is known in the prior art. U.S. Pat. No. 4,594,014 describes a fountain brush which utilizes gravity to apply a liquid by means of an applicator bush. Another type of liquid applicator is U.S. Pat. No. 4,838,722 discloses a device for dispensing flowable substances that has a piston rod type of valve which must be repositioned to allow the liquid to flow out onto an applicator brush. This device also requires gravity to induce the liquid out.

While these devices fulfill their respective, particular objectives and requirements, the need remains for a device that comprises no moving parts and does not required gravity to cause the liquid to be dispensed.

SUMMARY OF THE INVENTION

The present invention meets the needs presented above by the utilization of a squeezable housing in conjunction with a slit-valve mechanism to force the liquid out.

Still yet another object of the present invention is to provide a new liquid applicator device that allows the user to more precisely dispense the liquid from the housing.

Even still another object of the present invention is to provide a new liquid applicator device that requires the caps to remain coupled to the housing, thereby lessening the possibility that a small child using the device will inadvertently swallow either of the caps, hence making it safer.

To this end, the present invention generally comprises an elongate tubular housing that has a conical-shaped nose portion being disposed at a front end thereof, and a conical-shaped cap support portion that is disposed at a back end thereof. The housing is designed for storing a liquid. A valve member is disposed in the housing to regulate dispensing of the liquid from the housing. A brush cap member and an end-cap member are both removably attachable to either end of the housing, depending on which configuration the device is in, those being either a stored configuration, or an in-use configuration. A pair of elongate, cord-like securing members secures each of the cap members to the tubular member to prevent the child from inadvertently swallowing either of the caps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
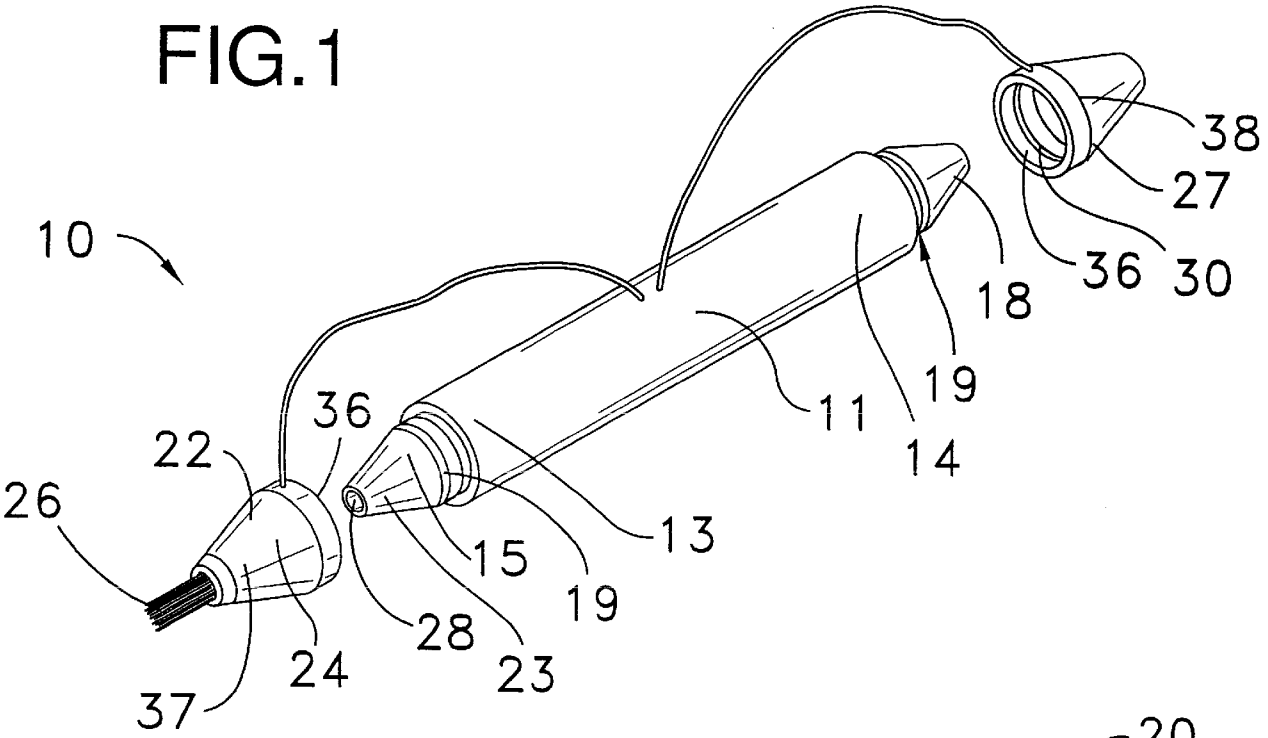
FIG. 1 is a schematic perspective view of a new liquid applicator device with both cap members detached from the housing according to the present invention.
Figure 3:
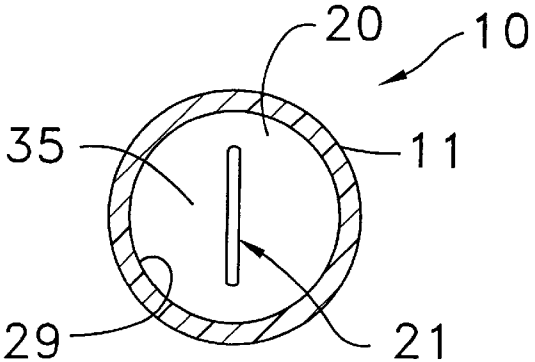
FIG. 3 is a schematic cross-sectional end view taken along sectional lines 3—3 of FIG. 2 of the present invention depicting the valve member.
Figure 2:
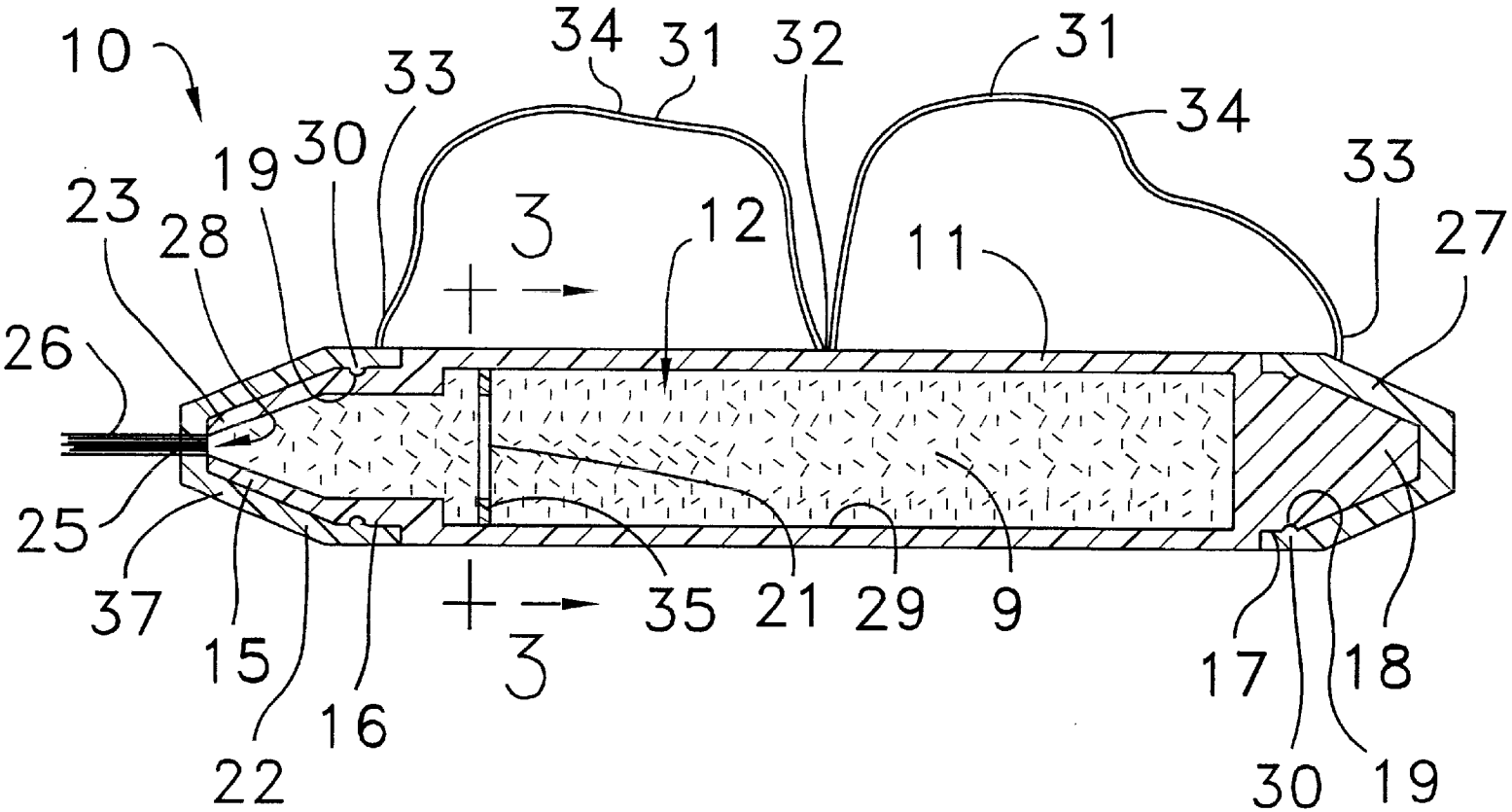
FIG. 2 is a schematic cross-sectional side view of the present invention with the cap members attached.

With reference now to the drawings, and in particular to FIGS. 1 through 3 thereof, a new liquid applicator device embodying the principles and concepts of the present invention and generally designated by the reference numeral 10 will be described.

As best illustrated in FIGS. 1 through 3, the liquid applicator device 10 generally comprises an elongate tubular housing 11 having a conical-shaped nose portion 15 being disposed at a front end 13 thereof, and also having a conical-shaped cap support portion 18 being disposed at a back end 14 thereof. A liquid-dispensing opening 28 is disposed through a tip 23 of the nose portion 15. The housing 11 includes a reservoir 12 disposed therein for storing a liquid 9, most preferably paint conducive to use by children.

The housing 11 comprises a resiliently flexible material such that the housing 11 is deformable in a manner to facilitate forcing of the liquid 9 out of the housing 11 through the opening 28.

The nose portion 15 has an annular groove 19 that is disposed in and about a rear portion 16 thereof.

The cap support portion 18 has an annular groove 19 that is disposed in and about a front portion 17 thereof.

A valve member 35 is disposed in the housing 11 to regulate dispensing of the liquid 9 from the housing 11. The valve member 35 comprises a flexible plate 20 that is attached to an interior wall 29 of the housing 11. The plate 20 is oriented substantially perpendicular to the interior wall 29 and is located proximate to the front end 13 of the housing 11. The plate 20 has a slit 21 that is centrally disposed therethrough and is designed to allow the liquid 9 to selectively pass through from the reservoir 12 to the nose portion 15 of the housing 11 only when a user applies pressure to the housing 11 thereby minimizing any excess flow or dripping that might otherwise occur.

A brush cap member 22 that is removably attachable to the housing 11 comprises a conical-shaped nose piece 24 that has an open end 36 thereof and also has a hole 25 that is disposed through a brush end 37 thereof. The nose piece 24 has bristles 26 that are securely disposed in the hole 25 and extend forward of the conical-shaped nose piece 24.

An end-cap member 27 that is removably attachable to the housing 11 comprises a conical-shaped cap piece 38 that has an open end 36.

Each of the cap members 22, 27 has an annular ridge 30 disposed in the open end for engaging the annular groove 19 in the nose portion 15 and the cap support portion 18 of the housing 11 such that each of the cap members 22, 27 is releasably attachable to either of the ends 13, 14 of the housing 11.

A pair of securing members 31 secures each of the cap members 22, 27 to the housing 11. Each of the securing members 31 comprises a cord 34 that has a first end 32 fixedly coupled to the housing 11, and a second end 33 fixedly coupled to one each of the cap members 22, 27. When the cap members 22, 27 are detached from either of the ends 13, 14 of the housing 11, a user such as a child is restricted from swallowing the cap members 22, 27.

In use, the parent reverses the cap members 22, 27 from the housing 11 and re-attaches each so that the brush cap member 22 is securely positioned on the nose portion 15 and the cap member 27 is positioned on the cap support portion 18 so the device is now ready for the child to use. The child then gently squeezes the housing 11 so that the liquid 9, or in the case where the device is filled with paint, flows through the valve member 35, the nose portion 15, the brush cap member 22, and the hole 25 onto the bristles 26 for the purpose of selectively applying the liquid 9.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid applicator device for selectively applying a liquid, said device comprising:

an elongate tubular housing having a conical-shaped nose portion being disposed at a front end thereof and also having a conical-shaped cap support portion being disposed at a back end thereof, said housing being adapted for storing the liquid therein;

a valve member being disposed in said housing to regulate dispensing of the liquid from said housing;

a brush cap member being removably attachable to said housing;

an end-cap member being removably attachable to said housing; and a pair of securing members for securing each of said cap members to said housing when detached from said ends of said housing.

2. A liquid applicator device as described in claim 1, wherein said housing comprises a resiliently flexible material such that said housing is deformable in a manner to facilitate forcing of the liquid through said valve member.

3. A liquid applicator device as described in claim 1, further comprising said housing further including a reservoir disposed therein.

4. A liquid applicator device as described in claim 1, further comprising a liquid-dispensing opening being disposed through a tip of said nose portion.

5. A liquid applicator device as described in claim 1, further comprising said nose portion having an annular groove being disposed in and about a rear portion thereof; and said cap support portion having an annular groove being disposed in and about a front portion thereof.

6. A liquid applicator device as described in claim 5, further comprising each of said cap members having an annular ridge being disposed in open ends thereof, for engaging said annular groove in said nose portion and said cap support portion of said housing, wherein each of said cap members are releasably attachable to either of said ends of said housing.

7. A liquid applicator device as described in claim 1, wherein said valve member comprises a flexible plate being attached to an interior wall of said housing, said plate being oriented substantially perpendicular to said interior wall and being located proximate to said front end of said housing.

8. A liquid applicator device as described in claim 7, further comprising said plate having a slit being centrally disposed therethrough and being adapted to allow the liquid to selectively pass therethrough, wherein the liquid is dispensed only when a user applies pressure to said housing thereby minimizing excess flow and dripping.

9. A liquid applicator device as described in claim 1, wherein said brush cap member comprises a conical-shaped nose piece having an open end thereof and also having a hole being disposed through a brush end thereof.

10. A liquid applicator device as described in claim 9, further comprising bristles being securely disposed in said hole and extending forwardly of said conical-shaped nose piece.

11. A liquid applicator device as described in claim 1, wherein each of said securing members comprises a cord having a first end fixedly coupled to said housing and a second end fixedly coupled to one each of said cap members, wherein when said cap members are detached from either of said ends of said housing, a user such as a child is restricted from swallowing said cap members.

12. A liquid applicator device for selectively applying a liquid, said device comprising:

an elongate tubular housing having a conical-shaped nose portion being disposed at a front end thereof and also having a conical-shaped cap support portion being disposed at a back end thereof, said housing including a reservoir disposed therein such that said housing is adapted for storing the liquid therein, a liquid-dispensing opening being disposed through a tip of said nose portion, wherein said housing comprises a resiliently flexible material such that said housing is deformable in a manner to facilitate forcing of the liquid out of the housing through said opening, said nose portion having an annular groove being disposed in and about a rear portion thereof, said cap support portion having an annular groove being disposed in and about a front portion thereof;

a valve member being disposed in said housing to regulate dispensing of the liquid from said housing, wherein said valve member comprises a flexible plate being attached to an interior wall of said housing, said plate having a slit being centrally disposed therethrough and being adapted to allow the liquid to selectively pass therethrough, wherein the liquid is dispensed only when a user applies pressure to said housing thereby minimizing excess flow and dripping;

a brush cap member being removably attachable to said housing, wherein said brush cap member comprises a conical-shaped nose piece having an open end thereof and also having a hole being disposed through a brush end thereof, said nose piece having bristles being securely disposed in said hole and extending forwardly of said conical-shaped nose piece;

an end-cap member being removably attachable to said housing, wherein said end cap member comprises a conical-shaped cap piece having an open end;

wherein each of said cap members has an annular ridge for engaging said annular groove in said nose portion and said cap support portion of said housing, wherein each of said cap members are releasably attachable to either of said ends of said housing; and a pair of securing members for securing each of said cap members to said housing when detached from said ends of said housing, wherein each of said securing members comprises a cord having a first end fixedly coupled to said housing and a second end fixedly coupled to one each of said cap members, wherein when said cap members are detached from either of said ends of said housing, a user such as a child is restricted from swallowing said cap members.

* * * * *